US009096347B2

(12) United States Patent
Minnette et al.

(10) Patent No.: US 9,096,347 B2
(45) Date of Patent: Aug. 4, 2015

(54) STAND-UP PACKAGE

(71) Applicant: Berry Plastics Corporation, Evansville, IN (US)

(72) Inventors: Jeffrey C Minnette, Evansville, IN (US); Ryan P Davidson, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 109 days.

(21) Appl. No.: 13/847,929

(22) Filed: Mar. 20, 2013

(65) Prior Publication Data

US 2013/0248526 A1 Sep. 26, 2013

Related U.S. Application Data

(60) Provisional application No. 61/613,301, filed on Mar. 20, 2012.

(51) Int. Cl.
*B65D 6/00* (2006.01)
*B65D 5/62* (2006.01)

(52) U.S. Cl.
CPC . *B65D 11/20* (2013.01); *B65D 5/62* (2013.01)

(58) Field of Classification Search
USPC ..... 220/9.1, 9.2, 9.4, 668, 647, 646, 62.11, 220/62.18, 62.21; 383/12, 119, 104
See application file for complete search history.

(56) References Cited

U.S. PATENT DOCUMENTS

| | | | | |
|---|---|---|---|---|
| 2,422,239 | A * | 6/1947 | Holt | 220/560.02 |
| 4,900,163 | A | 2/1990 | Mack | |
| 5,165,568 | A * | 11/1992 | Wischusen, III | 229/164.1 |
| 5,772,332 | A * | 6/1998 | Geller | 383/119 |
| 6,513,703 | B2 | 2/2003 | Becker | |
| 2005/0281494 | A1 * | 12/2005 | Allen et al. | 383/109 |
| 2011/0052106 | A1 | 3/2011 | Holmes et al. | |

OTHER PUBLICATIONS

International Search Report dated Jun. 6, 2013, relating to International Application No. PCT/US2013/033153.

* cited by examiner

*Primary Examiner* — Robert J Hicks
*Assistant Examiner* — Kareen Rush
(74) *Attorney, Agent, or Firm* — Barnes & Thornburg LLP

(57) ABSTRACT

A stand-up package is formed to include an interior region for containing a product. The package is configured to be in an upright, standing position.

20 Claims, 11 Drawing Sheets

STAND-UP PACKAGE

PRIORITY CLAIM

This application claims priority under 35 U.S.C. §119(e) to U.S. Provisional Application Ser. No. 61/613,301, filed Mar. 20, 2012, which is expressly incorporated by reference herein.

BACKGROUND

The present disclosure relates to a package, and in particular to a package made from plastics materials, and in particular, to a package that includes a box for holding food. More particularly, the present disclosure relates to a food package that stands upright when placed on a shelf.

SUMMARY

A package in accordance with the present disclosure is formed using a plastics material to include an interior product-storage region. In illustrative embodiments, the package includes top and bottom walls and front, rear, first side, and second side walls arranged to interconnect the top and bottom walls to form the interior product-storage region. In illustrative embodiments, a thin plastics film sheet material such as polypropylene is formed to define a pouch providing each of those walls. Artwork is printed on the thin plastics film sheet material before it is folded and formed to define the walls.

In illustrative embodiments, the package further includes a film-rigidifying frame located in the interior product-storage region and coupled permanently to one or more selected interior surfaces of selected walls forming the pouch. In one illustrative embodiment, the film-rigidifying frame is coupled to each of the walls except for the rear wall. In another illustrative embodiment, the film-rigidifying frame is coupled to each wall including the rear wall.

In illustrative embodiments, the film-rigidifying frame is coupled permanently using a suitable lamination or coupling process to an interior surface of a flat film blank that has been printed in advance to include artwork that will be visible to an observer after the package is formed. Then the laminated film blank is folded to produce a package having top, bottom, front, rear, and first and second side walls. Each wall has a rectangular shape in an illustrative embodiment of the present disclosure to provide the package with an upright box-like shape.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1B is a perspective view of a portion of a roll of film material used to form a pouch included in the stand-up package and suggesting that the film material includes a substrate made of a thin plastics film sheet material and graphics (artwork) printed on the substrate;

Figure 1C:
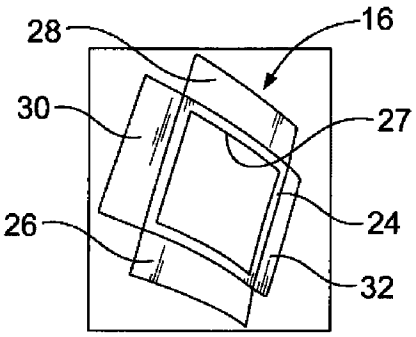
FIGS. 1B-1D are a series of perspective views showing components used to make the stand-up package of FIG. 1A.
Figure 1B:
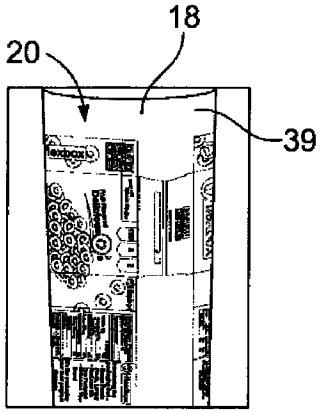
Figure 1D:
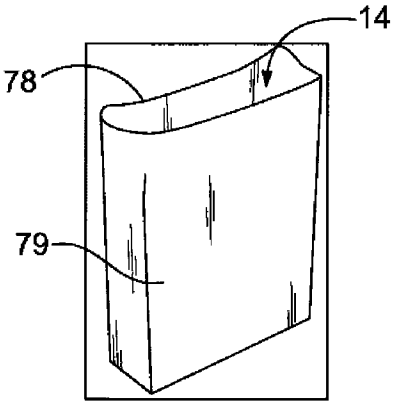
Figure 1A:
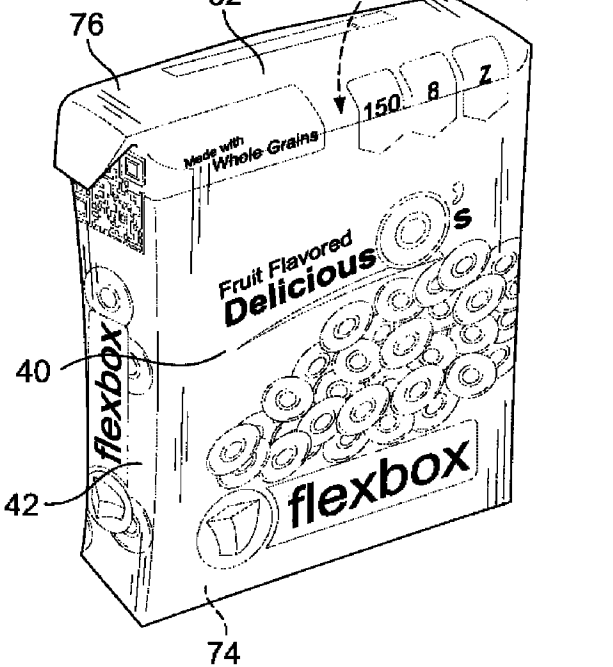
FIG. 1A is a perspective view of a package in accordance with the present disclosure showing that the package stands upright on a floor underlying the package and suggesting that the package has a generally box-like shape defined by six rectangular walls.
Figure 1E:
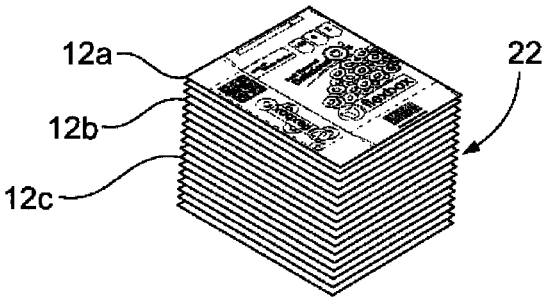
Figure 1F:
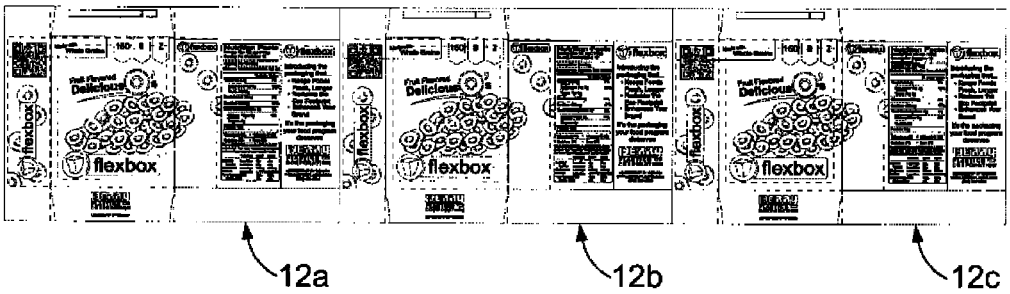
Figure 2:
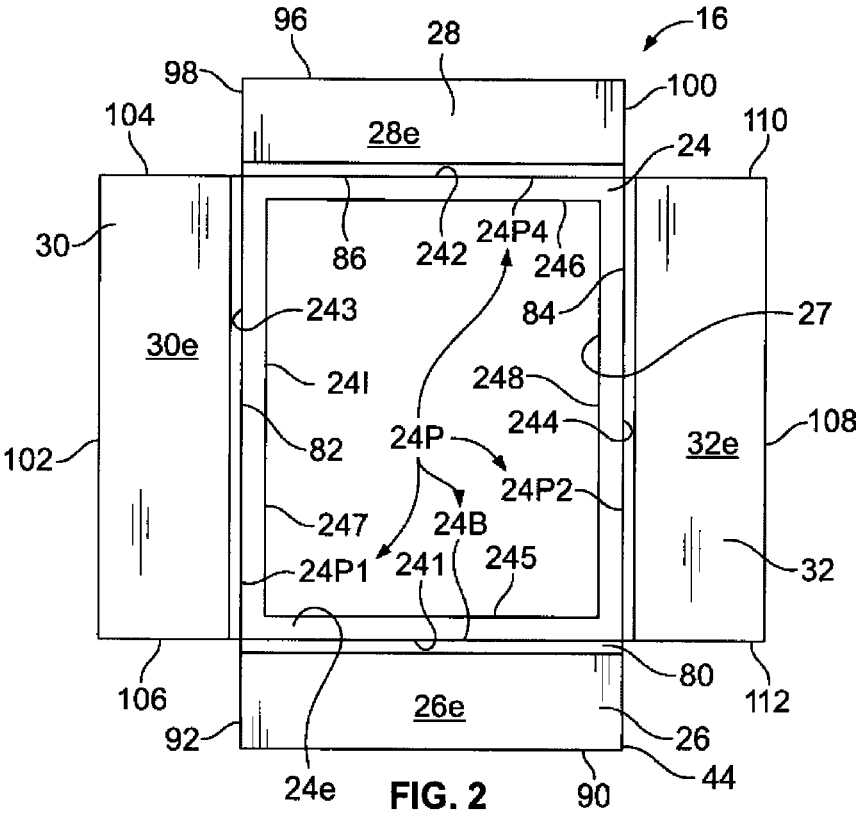
Figure 3:
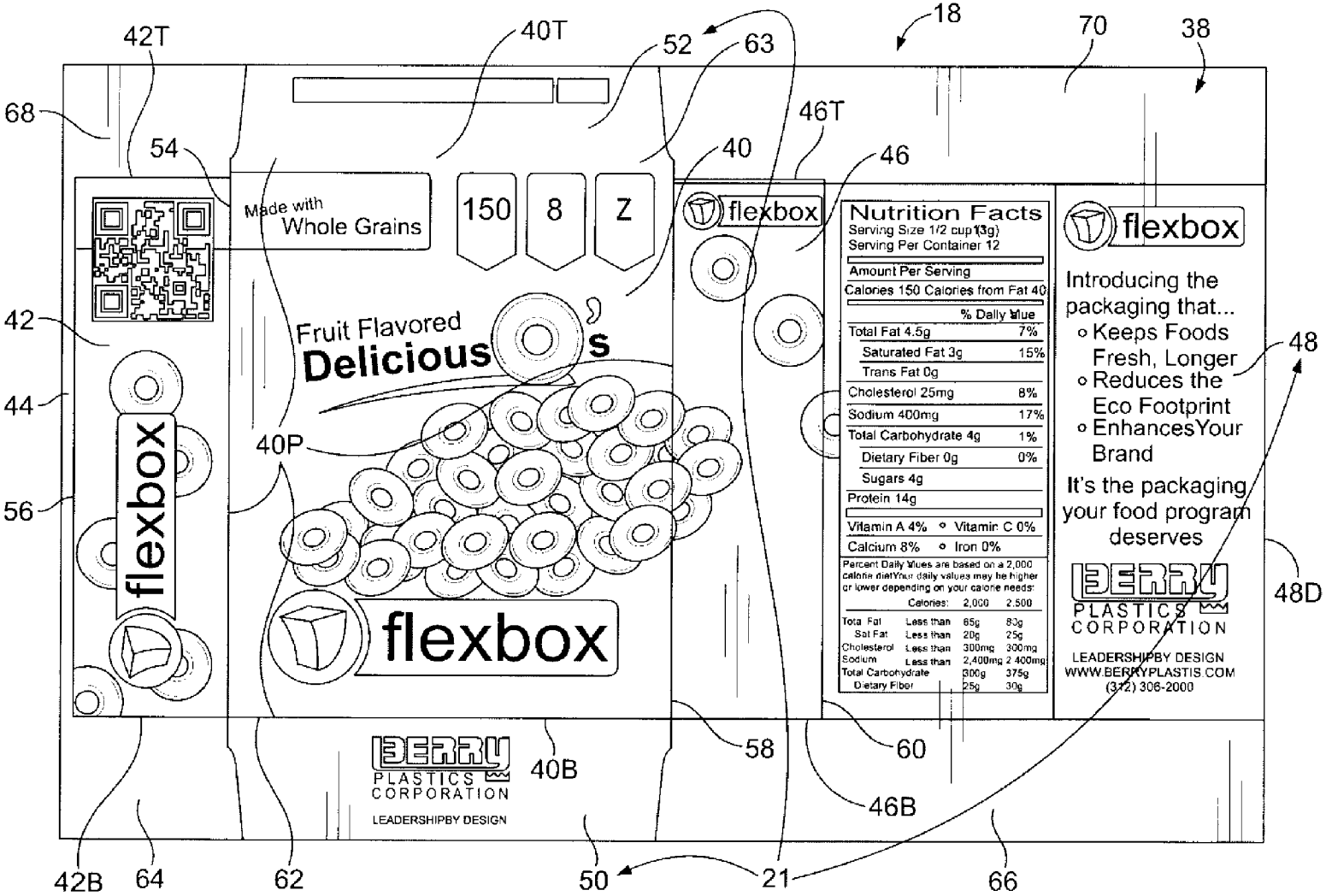
Figure 4:
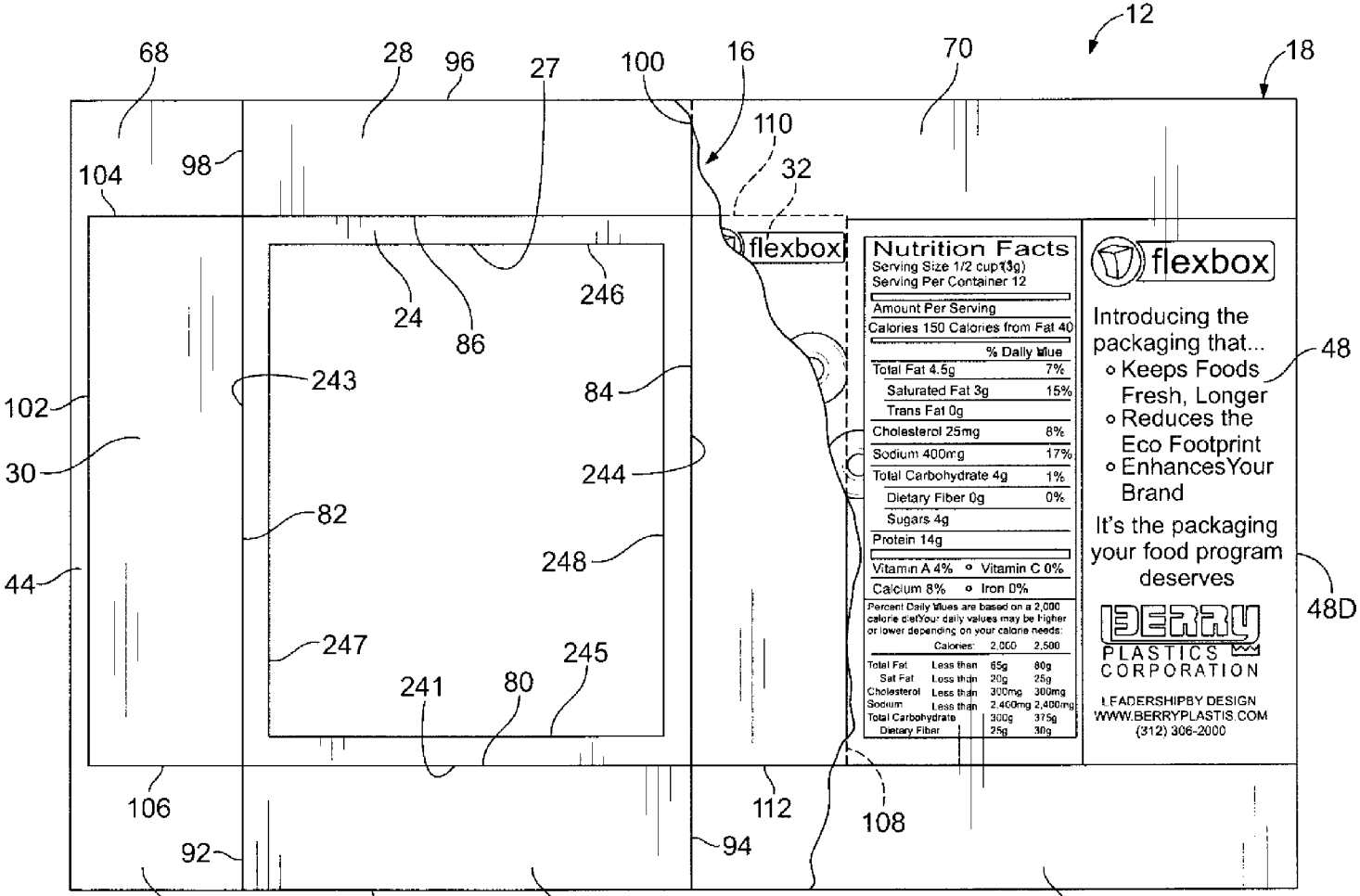
Figure 5:
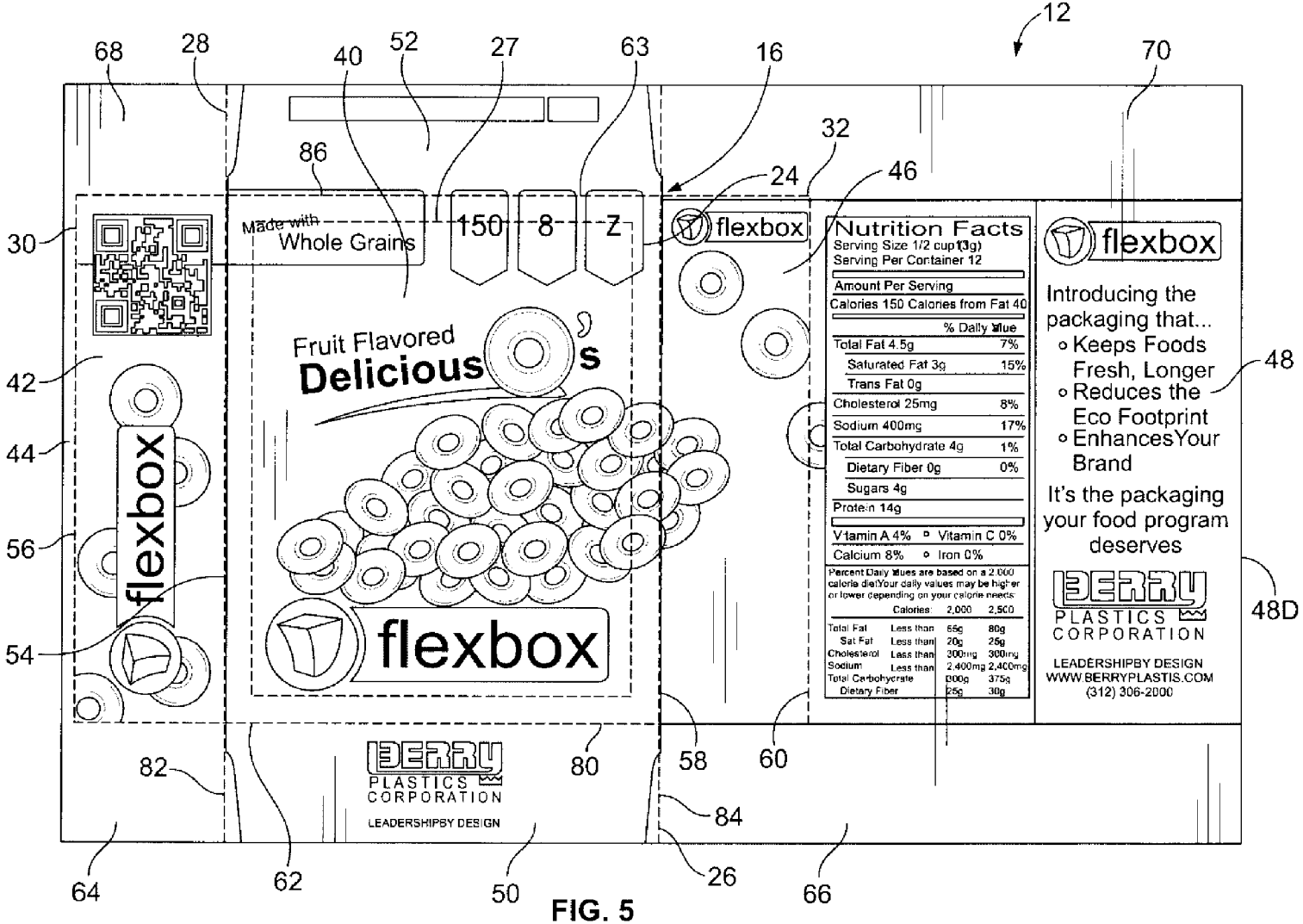
Figure 6:
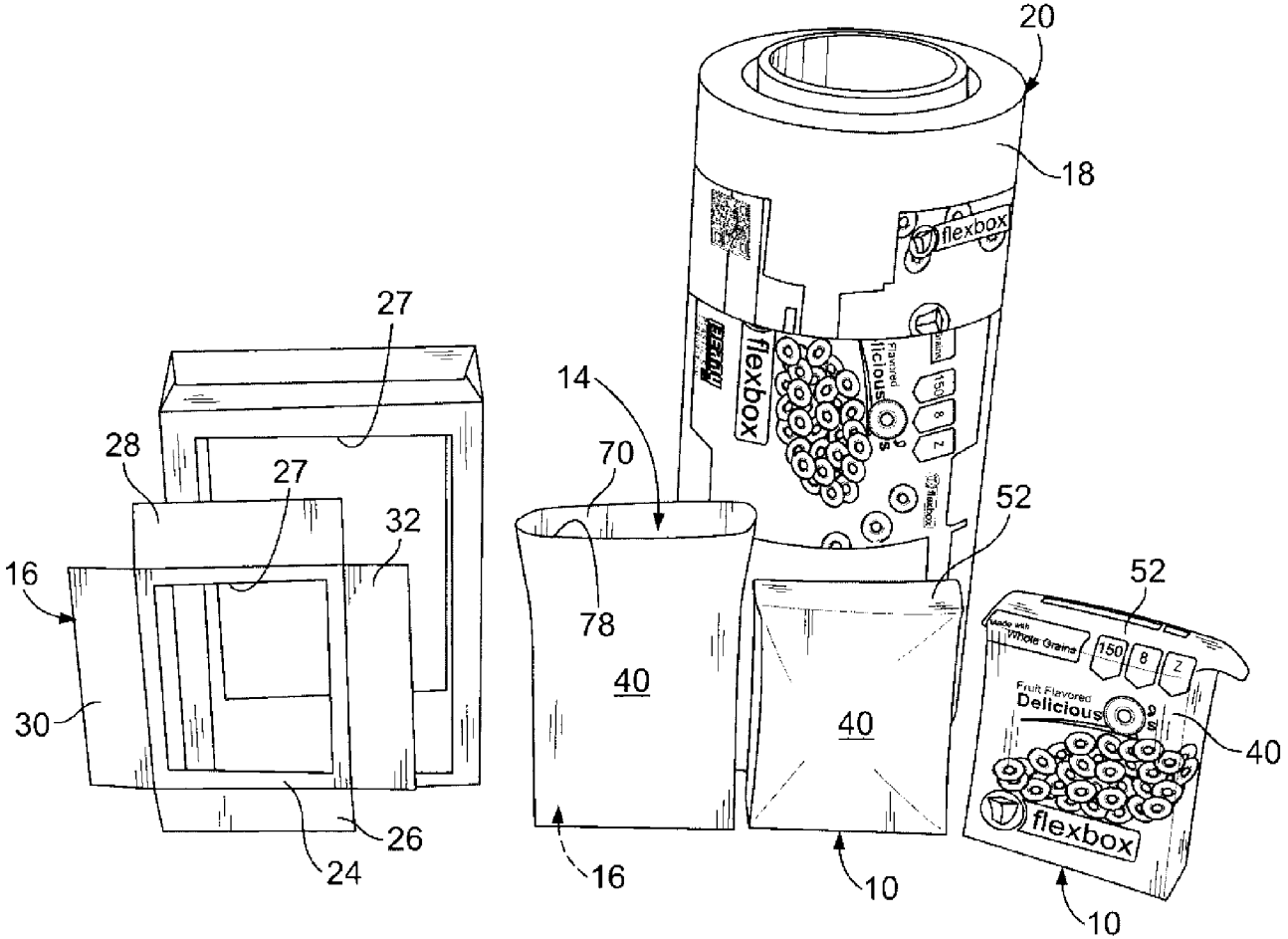
Figure 7:
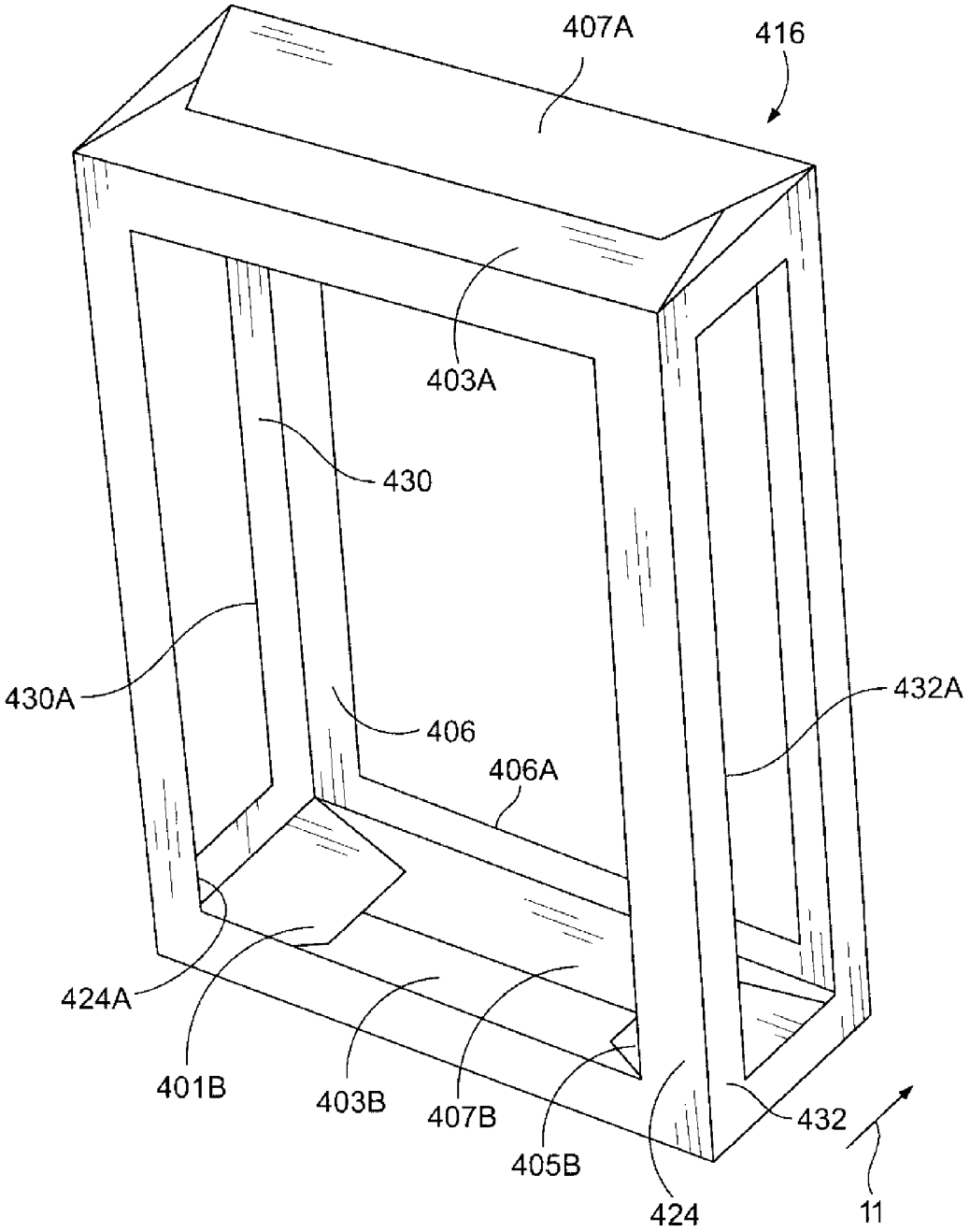
Figure 7A:
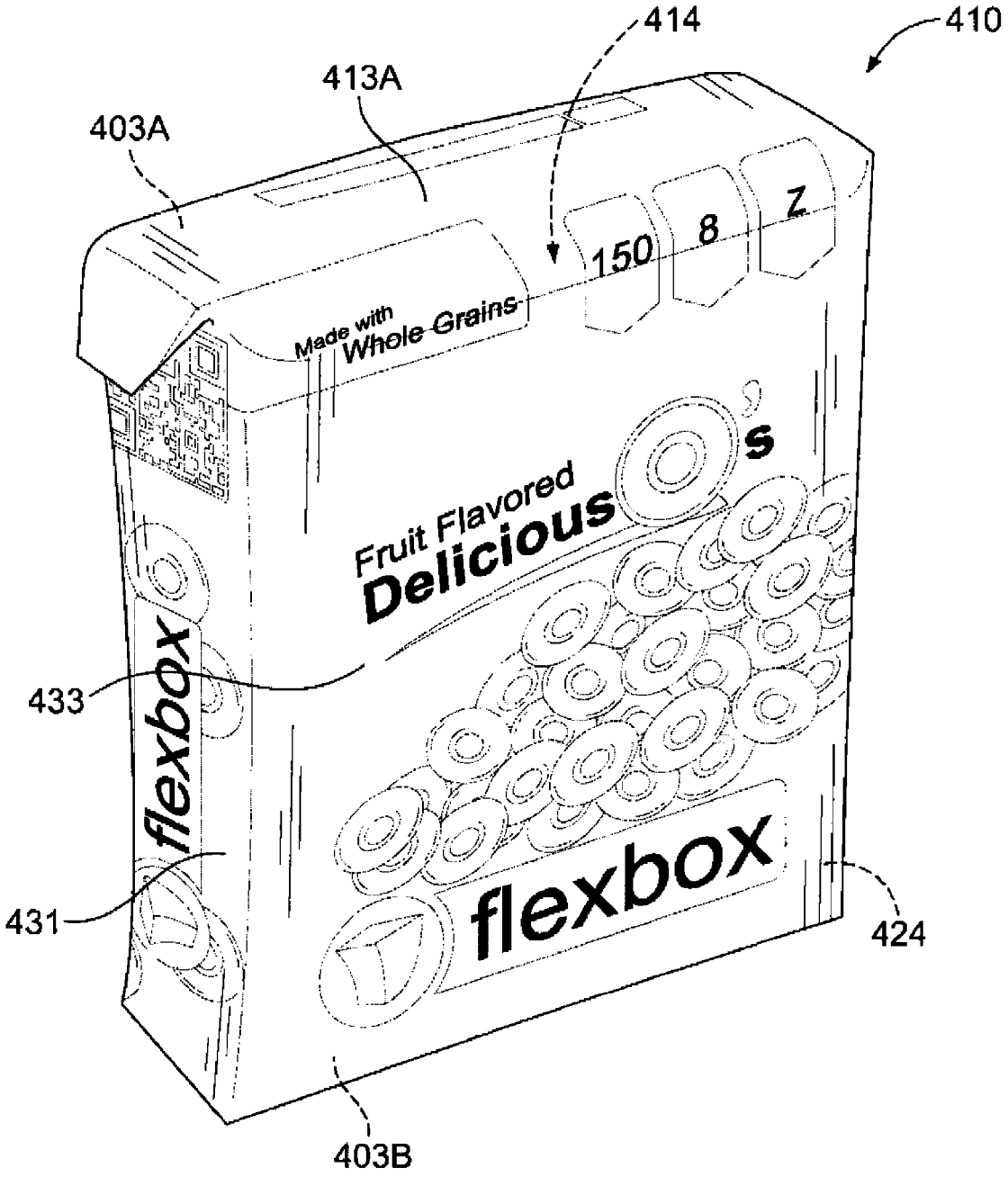
Figure 8:
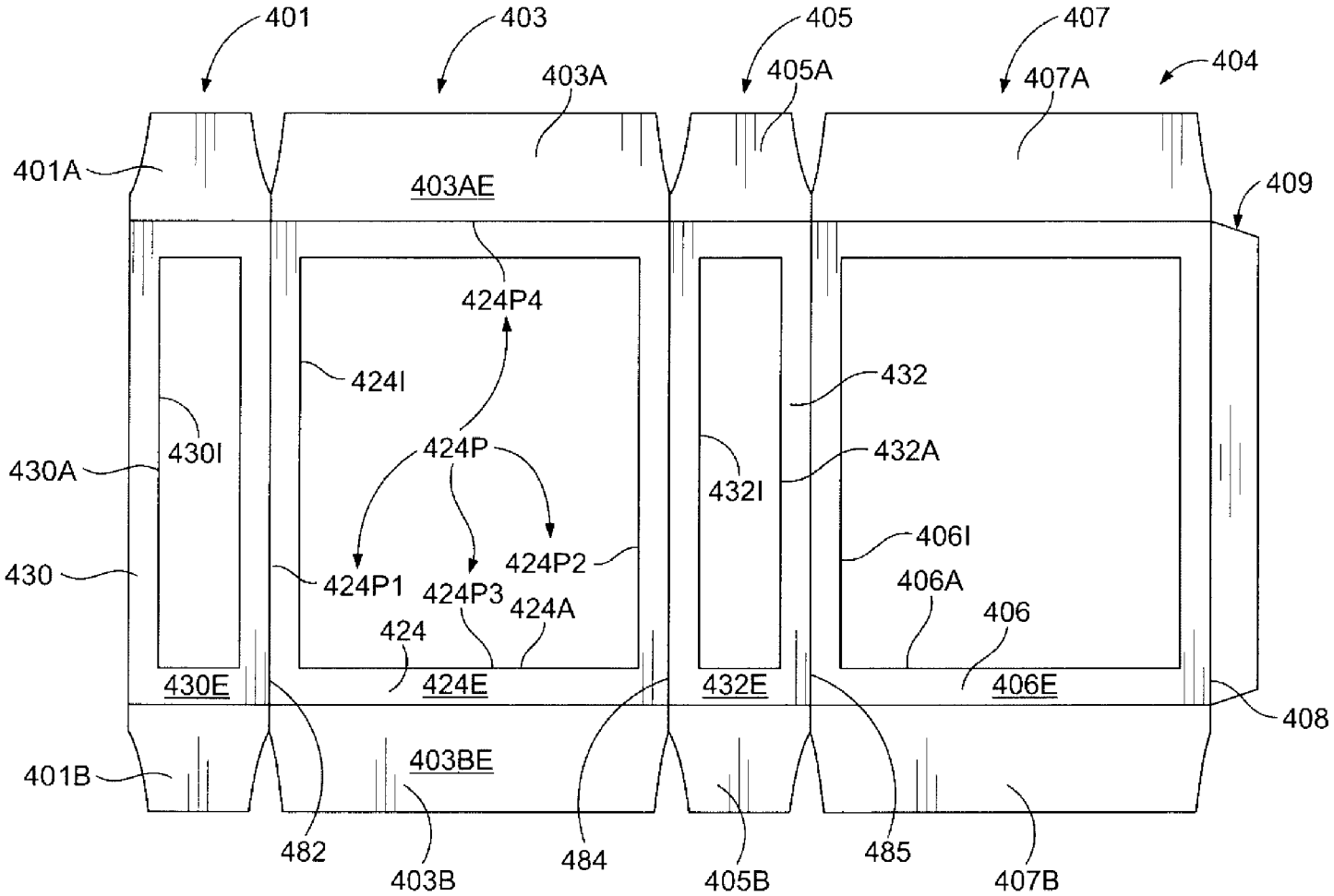
Figure 9:
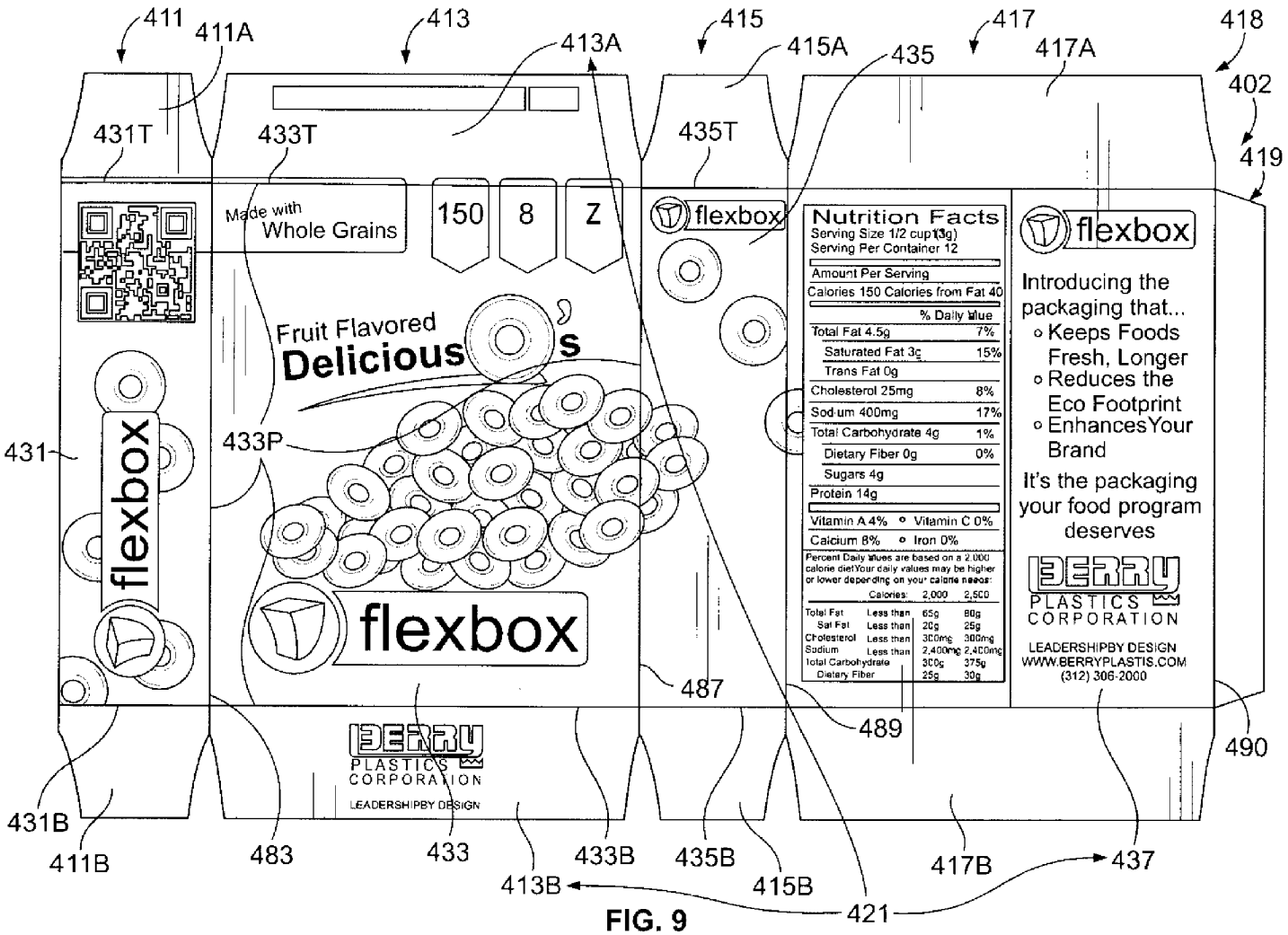
Figure 10:
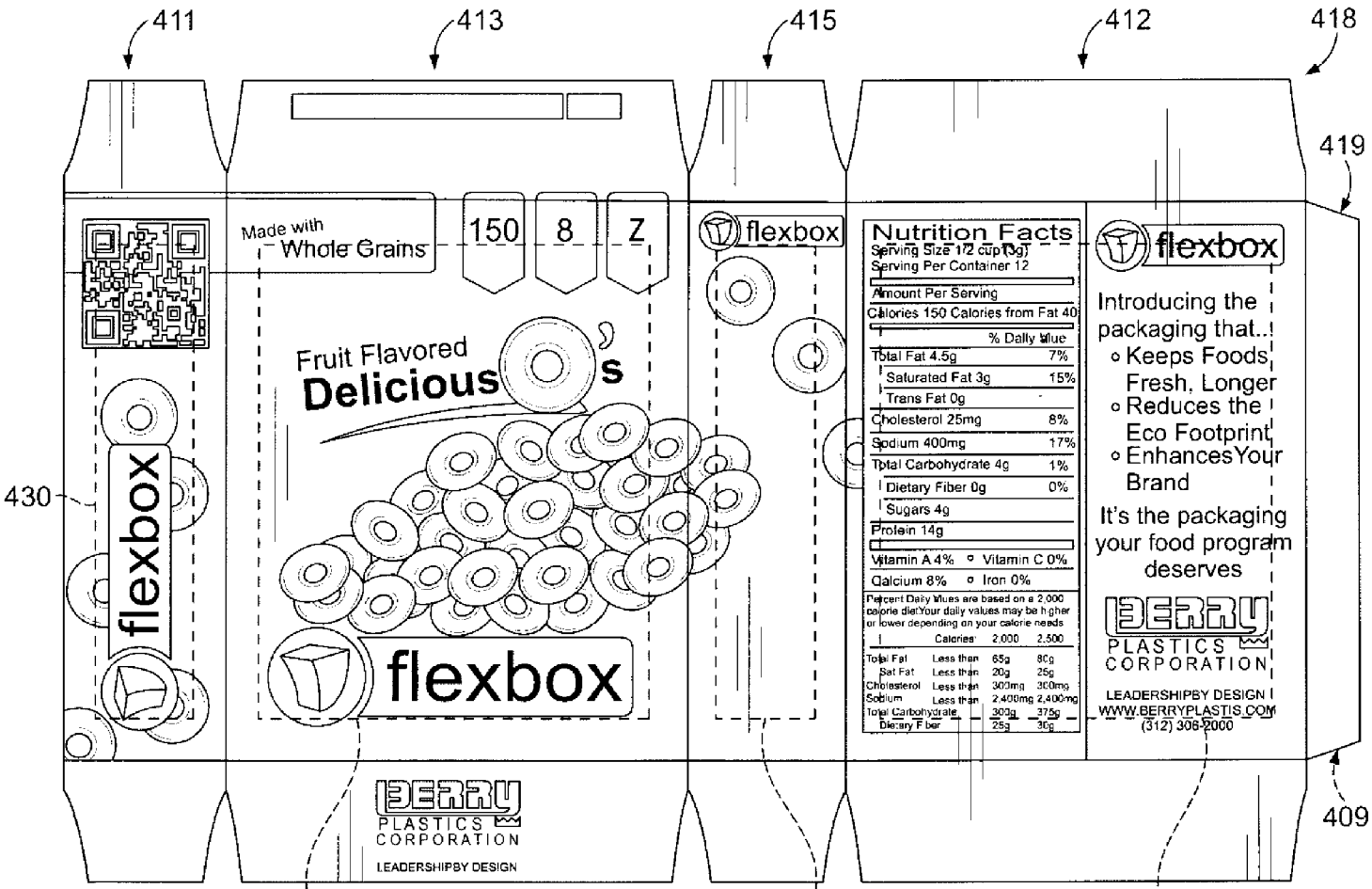

FIG. 1C is a perspective view of a film-rigidifying frame included in the stand-up package showing that the semi-rigid frame includes a front panel formed to include a rectangular aperture therein, a bottom panel coupled to the front panel along a bottom edge of the front panel, a first side panel coupled to the front frame panel along a first side edge of the front frame panel, a second side panel coupled to the front panel along a second side edge of the front panel, and a top panel coupled to the front panel along a top edge of the front panel;

FIG. 1D is an opened stand-up package formed as a result of laminating the film material to the semi-rigid frame to form a laminated package blank and folding the laminated package blank into a package establishing a container that is formed to include an interior product-storage region;

FIG. 1E is a perspective view of a stack of laminated package blanks that may be used in a container forming operation;

FIG. 1F is a plan view of a portion of a strip of laminated blanks that may be used in another container forming operation;

FIG. 2 is a top plan view of a frame blank used to form the semi-rigid frame of FIG. 1C showing that the front panel is formed to include a rectangular aperture, the bottom panel is coupled to the front panel along a bottom fold line, a first side panel is coupled to the front panel along a first side fold line, a second panel is coupled to the front panel along a second side fold line, and a top panel is coupled to the front panel along a top fold line;

FIG. 3 is an enlarged top plan view of a film blank showing that the film blank includes a front sheet centered between a NORTHERN top sheet, a WESTERN first side sheet, a SOUTHERN bottom sheet, and an EASTERN second side sheet and showing that the first side sheet is coupled to the front sheet along a first fold line, a mount tab is coupled to the first side sheet along a tab fold line, a second side sheet is coupled to the front sheet along a second fold line, a rear sheet is coupled to the second side sheet along a rear fold line, a bottom sheet is coupled to the front sheet along a bottom fold line, a first bottom fold tab is coupled o both the bottom sheet and the first side sheet, a second bottom fold tab is coupled to the bottom sheet, the second side sheet, and the rear sheet, a top sheet is coupled to the front sheet along a top fold line, a first top fold tab is coupled to both the top sheet and the first side sheet, and a second top fold tab is coupled to the top sheet, the second side sheet, and the rear sheet;

FIG. 4 is a top plan view of the laminated package blank formed as a result of laminating the film blank to the semi-rigid frame and showing that portions of the film blank have been broken away to reveal the semi-rigid frame positioned below the thin plastics film sheet material;

FIG. 5 is a view similar to FIG. 4 showing the semi-rigid frame (in phantom) after it has been laminated to the film material to establish the laminated package blank and showing that the front sheet of the film material is arranged to overlie and cover the front panel of the frame (shown in phantom), the first sheet of the film material is arranged to overlie and cover the first panel of the frame (shown in phantom), the second sheet of the film material is arranged to overlie and cover the second panel of the frame (shown in phantom), the bottom sheet of the film material is arranged to overlie and cover the bottom panel of the frame (shown in phantom), and the top sheet of the film material is arranged to overlie and cover the top panel of the frame (shown in phantom);

FIG. 6 shows various embodiments of components that may be used to form various stand-up packages in accordance with the present disclosure;

FIG. 7A is a perspective view of another embodiment of a package in accordance with the present disclosure showing that the package stands upright on the floor underlying the package and suggesting that the package has a generally box-like shape defined by six rectangular walls;

FIG. 7 is a perspective view of a film-rigidifying frame included in the package of FIG. 7A showing that the semi-rigid frame includes a rear panel in addition to a front panel, a first side panel, and a second side panel, and showing that each panel of the frame is formed to include a rectangular aperture so that weight of the semi-rigid frame is minimized;

FIG. 8 is a top plan view of a frame blank used to form the film-rigidifying frame of FIG. 7 showing that the frame blank includes, from left to right, a first frame strip including the first panel and first top and bottom wings, a front frame strip including the front panel formed to include the rectangular aperture therein and top and bottom front tabs, a second frame strip including the second panel and second top and bottom wings, a rear frame strip including the rear panel formed to include the rectangular aperture therein and top and bottom rear tabs, and a coupling strip;

FIG. 9 is a plan view of a film blank used to form the package of FIG. 1 showing that the film blank includes, from left to right, a first film band including a first side sheet and first top and bottom flaps, a front film band including a front sheet and top and bottom front flaps, a second film band including a second side sheet and second top and bottom flaps, a rear film band including a rear sheet and top and bottom rear flaps, and a coupling band; and FIG. 10 is a plan view of another embodiment of a laminated package blank in accordance with the present disclosure showing that the laminated blank includes the film blank of FIG. 9 laminated to the frame blank of FIG. 8 to cause the first film band to overlie the first frame strip, the front film band to overlie the front frame strip, the second film band to overlie the second frame strip, the rear film band to overlie the rear frame strip, and the coupling band to overlie the coupling strip.

DETAILED DESCRIPTION

A package in accordance with the present disclosure is formed using a plastics material to include an interior product-storage region. One illustrative package 10 without a rigidified rear wall is shown, for example, in FIGS. 1-6, while another illustrative package 410 is shown, for example, in FIGS. 7A-10. In illustrative embodiments, each package 10, 410 includes top and bottom walls and front, rear, first side, and second side walls arranged to interconnect the top and bottom walls to form the interior product-storage region. In illustrative embodiments, a thin plastics film sheet material 18 or 418 such as polypropylene is formed to define a pouch providing each of those walls. Artwork is printed on the thin plastics film sheet material before it is folded and formed to define the walls.

In illustrative embodiments, a package in accordance with the present disclosure further includes a film-rigidifying frame located in the interior product-storage region and coupled permanently to selected interior surfaces of selected walls forming the pouch. In one illustrative embodiment suggested in FIGS. 1-6, a film-rigidifying frame 16 is coupled to each of the walls except for the rear wall. In another illustrative embodiment suggested in FIGS. 7A-10, a film-rigidifying frame 416 is coupled to each wall including the rear wall.

In illustrative embodiments, the film-rigidifying frame 16 or 416 is coupled permanently using a suitable lamination or coupling process to an interior surface of a flat film blank that has been printed to include artwork to form a laminated package blank. Then the laminated package blank is folded to produce a package having top, bottom, front, rear, and first and second side walls. Each wall has a rectangular shape in an illustrative embodiment of the present disclosure to provide the package with an upright box-like shape.

A package 10 in accordance with the present disclosure comprising a film-rigidifying frame 16 and a pouch 18 is suggested in FIGS. 1-6 while an alternative package 410 comprises a film-rigidifying frame 416 and a pouch 418 is suggested in FIGS. 7-10. In the descriptions below, components relating to the embodiment of FIGS. 7-10 are placed in parenthesis. The primary figure references relate to the embodiment of FIGS. 1-6.

Film-rigidifying frame 16 (416) includes a front panel 24 (424) having a perimeter edge 24P (424P) as suggested in FIG. 2 (see also FIGS. 7 and 8). Film-rigidifying frame 16 (416) further includes a first side panel 30 (430) coupled to a first side segment 24P1 (424P1) of perimeter edge 24P (424P) of front panel 24 (424). First side panel 30 (430) is arranged to lie at about a right angle to front panel 24 (424) when package 10 (410) is formed. Film-rigidifying frame 16 (416) further includes a second side panel 32 (432) coupled to a second side segment 24P2 (424P2) of perimeter edge of front panel 24 (424) and arranged to lie at about a right angle to front panel 24 (424) and in substantially spaced-apart parallel relation to first side panel 30 (430) when package 10 (410) is formed.

Pouch 18 (418) is made of a thin plastics film sheet material 20 and is formed to include an interior region 14 (414) adapted to contain products therein and sized to receive film-rigidifying frame 16 (416) therein as suggested in FIG. 3 (see also FIG. 9). Pouch 18 (418) includes a front sheet 40 (433) having an interior surface arranged to face toward interior region 14 (414) and coupled permanently to an exterior surface 24E (424E) of front panel 24 (424) to rigidify front sheet 40 (433). Pouch 18 (418) further includes a first side sheet 42 (431) having an interior surface arranged to face toward interior region 14 (214) and coupled permanently to an exterior surface 30E (430E) of first side panel 30 (430) to rigidify first side sheet 40 (433). Pouch 18 (418) further includes a second side sheet 46 (435) having an interior surface arranged to face toward interior region 14 (414) and first side sheet 42 (431) and coupled permanently to an exterior surface 32E (432E) of second side panel 32 (432) to rigidify second side sheet 46 (534) as suggested in FIG. 3 (see also FIG. 9). Pouch 18 (418) further includes a closure 21 (421) coupled to each of front sheet 40 (433), first side sheet 42 (431), and second side sheet 46 (435) to establish interior region 14 (414) of pouch 18 (418) as a closed volume.

Closure 21 (421) of pouch 18 (418) is suggested in FIG. 3 (see also FIG. 9) and includes a bottom sheet 50 (413B) coupled to a bottom edge 40B, 42B, 46B (433B, 431B, 435B) of each of front sheet 40 (433) and first and second side sheets 42, 46 (431, 435), a top sheet 52 (403A) coupled to an opposite top edge 40T, 42T, 46T (433T, 431T, 435T) of each of the front sheet 40 (433) and first and second side sheets 42, 46 (431, 435) and arranged to lie in substantially spaced-apart parallel relation to bottom sheet 50 (413B). Closure 21 (421) further includes a rear sheet 48 (437) coupled to each of the first, second, top, and bottom sheets 50, 52, 42, 32 (413B, 403A, 431, 432) and arranged to lie in substantially spaced-apart parallel relation to front sheet 40 (433).

Front panel 24 (424) further includes an interior edge 241 (424I) arranged to lie in spaced-apart relation to perimeter edge 24P (424P) as shown in FIG. 3 (see also FIG. 9). Interior edge 241 (424I) has a rectangular shape to cause front panel 24 (424) to mate only with a perimeter border 40P (433P) portion of front sheet 40 (433).

In the embodiment of FIGS. 1-6, rear sheet 48 of pouch 18 is not coupled to film-rigidifying frame 16. Rear sheet 48 is formed to define a portion of interior region 14 of the pouch 18 as suggested in the embodiment shown in FIGS. 1-6. Film-rigidifying frame 16 is separated from rear sheet 48 of pouch 18. Perimeter edge 24P of front panel 24 further includes a bottom segment 24P3. Bottom segment 24P3 is arranged to interconnect first and second side segments 24P1, 24P2.

Film-rigidifying frame 16 further includes a bottom panel 26 coupled to bottom segment 24P3 of perimeter edge 24P of front panel 24 and arranged to lie at about a right angle to front panel 24 as shown in FIG. 2. Bottom sheet 50 of pouch 18 has an interior surface arranged to face toward interior region 14 and is coupled permanently to an exterior surface 26E of bottom panel 26 to rigidify bottom sheet 50. It is within the scope of the present disclosure to make such a coupling that is not permanent.

Perimeter edge 24P of front panel 24 further includes a top segment 24P4 arranged to interconnect first and second side segments 24P1, 24P2 as shown in FIG. 3. Top segment 24P4 is arranged to lie in substantially spaced-apart parallel relation to bottom segment 24P3.

Film-rigidifying frame 16 further includes a top panel 28 coupled to top segment 24P4 of perimeter edge 24P of perimeter edge 24P of front panel 24 as shown in FIG. 2. Top panel 28 is arranged to lie at about a right angle to front panel 24. Top sheet 52 of pouch 18 has an interior surface arranged to face toward interior region 14 and is coupled permanently to an exterior surface 28E of top panel 28 to rigidify top sheet 52. It is within the scope of the present disclosure to make such a coupling that is not permanent.

First side edge 243, bottom edge 241, second side edge 244, and top edge 242 are arranged to lie in series to provide perimeter edge 24P of front panel 24 as shown in FIG. 2. Perimeter edge 24P has a rectangular shape in an illustrative embodiment.

Front panel 24 further includes an interior edge 241 arranged to lie in spaced-apart relation to perimeter edge 24P as shown in FIG. 2. Interior edge 241 has a rectangular shape to cause front panel 24 to mate only with a perimeter border portion 40P of front sheet 40.

In the embodiment of FIGS. 7-10, rear sheet 437 of pouch 418 is coupled to film-rigidifying frame 416. Film-rigidifying frame 416 further includes a rear panel 406 coupled to each of first and second side panels 430, 432 as suggested in the embodiment shown in FIGS. 7-10. Rear panel 406 is arranged to extend from first side panel 430 to second side panel 432 and lie in substantially spaced-apart parallel relation to front panel 424. Rear sheet 437 of pouch 418 has an interior surface arranged to face toward front sheet 433 of pouch 418 and is coupled permanently to an exterior surface 406E of rear panel 406 to rigidify rear sheet 437. It is within the scope of the present disclosure to make such a coupling that is not permanent.

Perimeter edge 424P of front panel 424 further includes a bottom segment 424P3 arranged to interconnect first and second side segments 424P1, 424P2 as shown in FIG. 8. Film-rigidifying frame 416 further includes a bottom panel 403B. Bottom panel 403B is coupled to bottom segment 424P3 of perimeter edge 424P of front panel 424. Bottom panel 403B is arranged to lie at about a right angle to front panel 424. Bottom sheet 413B of pouch 418 has an interior surface arranged to face toward interior region 414 and coupled permanently to an exterior surface 403BE of bottom panel 403B to rigidify bottom sheet 433. It is within the scope of the present disclosure to make such a coupling that is not permanent.

Perimeter edge 424P of front panel 424 further includes a top segment 424P4 arranged to interconnect first and second side segments 424P1, 424P2 and lie in substantially spaced-apart parallel relation to bottom segment 424P3 as shown, for example, in FIG. 8. Film-rigidifying frame 416 further includes a top panel 403A coupled to top segment 424P4 of perimeter edge 424P of front panel 424 and is arranged to lie at about a right angle to front panel 424. Top sheet 413A of pouch 418 has an interior surface arranged to face toward interior region 414 and is coupled permanently to an exterior surface 403AE of top panel 403A to rigidify top sheet 413A. It is within the scope of the present disclosure to make such a coupling that is not permanent.

Each of front, rear, first side, and second side panels 424, 406, 430, 432 are formed to include an interior edge 424I, 406I, 430I, 432I forming a boundary of an aperture 424A, 406A, 430A, 432A as suggested in FIG. 8. Each of the front, rear, first side, and second side panels 424, 406, 430, 432 are rectangle-shaped and formed to include a rectangle-shaped aperture 424A, 406A, 430A, 432A therein.

A first embodiment of a stand-up package 10 in accordance with the present disclosure is shown in FIGS. 1A and 6. Stand-up package 10 is formed during a package-forming operation in which a laminated package blank 12, shown in FIG. 5, is formed into an opened package having an interior product-storage region 14, products are placed in interior product-storage region 14, and opened package is sealed to form stand-up package 10. Stand-up package 10 includes a semi-rigid frame 16 and a pouch 18 comprising a film and also called film 18, as shown in FIGS. 2-4. During blank manufacturing, film 18 is laminated to semi-rigid frame 16 to establish laminated package blank 12. Another embodiment of a semi-rigid frame 416 in accordance with the present disclosure is shown, for example, in FIGS. 7 and 10.

Stand-up package 10 includes semi-rigid frame 16 and pouch 18 made of film. Semi-rigid frame 16 includes, for example, a generally planar and rectangular front panel 24 and one or more generally planar and rectangular frame panels. Frame panels include a first side panel 30 and a second side panel 32, and may include a bottom panel 26 and a top panel 28, as shown, for example, in FIGS. 1C and 2.

Front panel 24 includes a generally linear bottom edge 241, a generally linear top edge 242, a generally linear first side edge 243, and a generally linear second side edge 244. Top edge 242 is spaced apart from and generally parallel to bottom edge 241. Second side edge 244 is spaced apart from and generally parallel to first side edge 243. Front panel 24 is formed to include a rectangular aperture 27 spaced apart from the edges 241, 242, 243, 244 to minimize weight of front panel 24. Front panel 24 thereby includes a relatively narrow rectangular peripheral aperture-border wall that extends around aperture 27.

Aperture 27 is formed by a generally linear inner bottom edge 245 that is spaced apart from and generally parallel to bottom edge 241, a generally linear inner top edge 246 that is spaced apart from and generally parallel to top edge 242, a generally linear inner first edge 247 that is spaced apart from and generally parallel to first edge 243, and a generally linear inner second edge 248 that is spaced apart from and generally parallel to second edge 244. Bottom panel 26 of frame 16 is coupled to front panel 24 along bottom edge 241. Top panel 28 is coupled to front panel 24 along top edge 242. First side panel 30 is coupled to front panel 24 along first edge 243. Second side panel 32 is coupled to front panel 24 along second edge 244.

Bottom panel 26, top panel 28, first side panel 30 and second side panel 32 are each generally planar and rectangular in illustrative embodiment of the present disclosure. Bottom panel 26 includes a generally linear distal edge 90 that is spaced apart from and parallel to bottom edge 241 of front panel 24 and a generally linear first side edge 92 and a generally linear second side edge 94 that extend between and generally perpendicular to distal edge 90 and bottom edge 241 of front panel 24. Top panel 28 includes a generally linear distal edge 96 that is spaced apart from and generally parallel to top edge 242 of front panel 24 and a generally linear first side edge 98 and a generally linear second side edge 100 that extend between and generally perpendicular to distal edge 96 and top edge 242 of front panel 24.

First side panel 30 of frame 16 includes a generally linear distal edge 102 that is spaced apart from and generally parallel to first edge 243 of front panel 24, a generally linear top side edge 104, and a generally linear bottom side edge 106 that extends between and generally perpendicular to distal edge 102 and first side edge 243 of front panel 24. Second side panel 32 of frame 16 includes a generally linear distal edge 108 that is spaced apart from and generally parallel to second edge 244 of front panel 24, a generally linear top side edge 110, and a generally linear bottom side edge 112 that extends between and generally perpendicular to distal edge 108 and second edge 244 of front panel 24. Bottom panel 26, top panel 28, first side panel 30 and second side panel 32 may each be formed to include one or more apertures configured and sized to minimize weight of the panels.

Film 18 includes a substrate and a printed layer. As an example, graphics are printed onto the substrate to form film 18. Film 18 includes a sheet 38 and scrap 39 which is trimmed from sheet 38 when film 18 is laminated to an outer surface of semi-rigid frame 16 to form laminated package blank 12. As a result, laminated package blank is formed by joining semi-rigid frame 16 to a film blank 38 included in film 18.

Film blank 38 includes a front sheet 40, a first side sheet 42, a mount tab 44, a second side sheet 46, a rear sheet 48, a bottom sheet 50, a first bottom fold tab 64, a second bottom fold tab 66, a top sheet 52, a first top fold tab 68, and a second top fold tab 70 as shown, for example, in FIG. 3. First side sheet 42 is coupled to front sheet 40 along a first film fold line 54. Mount tab 44 is coupled to first side sheet 42 along a tab fold line 56. Second side sheet 46 is coupled to front sheet 40 along a second film fold line 58. Rear sheet 48 is coupled to second side sheet 46 along a rear film fold line 60. Bottom sheet 50 is coupled to front sheet 40 along a bottom film fold line 62. First bottom fold tab 64 is coupled to both bottom sheet 50 and first side sheet 42. Second bottom fold tab 66 is coupled to bottom sheet 50, second side sheet 46, and rear sheet 48. Top sheet 52 is coupled to front sheet 40 along a top film fold line 63. First top fold tab 68 is coupled to both top sheet 52 and first side sheet 42. Second top fold tab 70 is coupled to top sheet 52, second side sheet 46, and rear sheet 48. Front sheet 40, first side sheet 42, second side sheet 46, and rear sheet 48 are each generally planar and rectangular in an illustrative embodiment of the present disclosure.

During lamination, film blank 38 is aligned with semi-rigid frame 16 to cause portions of film blank 38 to be laminated to semi-rigid frame 16 as shown in FIG. 5. In an illustrative example, front sheet 40 is arranged to overlie and cover front panel 24 of frame 16. First side sheet 42 is arranged to overlie and cover first side panel 30. Second sheet 46 is arranged to overlie and cover second side panel 32. Bottom sheet 50 is arranged to overlie and cover bottom panel 26. Top sheet 52 is arranged to overlie and cover top panel 28. As an example, mount tab 44, rear sheet 48, first and second bottom fold tabs 64, 66, and first and second top fold tabs 68, 70 do not lie over or cover semi-rigid frame 16.

Laminated package blank 12 may be transported for container forming at another location in a laminated roll 20 or in a stack 22 as shown in FIGS. 1E, 1F, and 6. Laminated roll 20 is formed by joining a series of laminated package blanks 12*a*, 12*b*, 12*c* together as suggested in FIG. 1F. Stack 22 may be formed by stacking laminated plastic blanks 12*a*, 12*b*, 12*c* one on top of another. Stack 22 and laminated roll 20 minimize storage and transportation space associated with use of laminated package blank 12.

Once laminated package blank 12 is established, laminated package blank 12 may be used in a container-forming process in accordance with the present disclosure. In one example, the container-forming process includes the operations of forming a sleeve 79, forming a bottom end seal 74, filling stand-up package 10, and forming a top end seal 76. Once the container-forming process is completed, products are stored in an interior product-storage region defined by sleeve 79, bottom end seal 74, and top end seal 76.

During the sleeve-formation step, first side panel 30 and second side panel 32 are folded relative to front panel 24 to provide stand-up package 10 with an upright orientation and generally rectangular shape. First side panel 30 and first side sheet 42 are folded in a clockwise direction respectively about a first frame fold line 82 and first film fold line 54 toward interior product-storage region 14. As a result, first panel 30 and first side sheet 42 are arranged to extend away from front panel 24 and front sheet 40 at about a right angle.

Second panel 32 and second sheet 46 are folded in a counter-clockwise direction respectively about a second frame fold line 84 and second film fold line 58 toward interior product-storage region 14. As a result, second panel 32 and second side sheet 46 are arranged to extend away from front panel 24 and front sheet 40 at about a right angle and lie spaced apart from and generally parallel to first side panel 30 and first side sheet 42. First side panel 30 and first side sheet 42, and second side panel 32 and second side sheet 46, extend away from front panel 24 in the same direction. An opening in communication with interior product-storage region 14 is formed by and between distal edge 102 of first side panel 30 and distal edge 108 of second side panel 32.

Rear sheet 48 of film 18 is then positioned to extend between distal edge 102 of first side panel 30 and distal edge 108 of second side panel 32 and to overlie and cover the opening formed between distal edges 102 and 108 of first side panel 30 and second side panel 32. A distal edge 48D of rear sheet 48 is positioned to overlap mount tab 44. Distal edge 48D is coupled to mount tab 44 to cause sleeve 79 to be formed as result. In one example, distal edge 48D is coupled to mount tab 44 by applying heat and forming a heat seal. In another example, distal edge 48D is coupled to mount tab 44 by glue or any other suitable alternative.

During the formation of bottom end seal 74, second bottom fold tab 66 is first folded inwardly toward interior product-storage region 14. Next, first bottom fold tab 64 is folded inwardly toward interior product-storage region 14 to lie in confronting relation with second bottom fold tab 66. Next, bottom sheet 50 is folded about bottom film fold line 62 toward interior product-storage region 14 to cause bottom sheet 50 to overlie first and second bottom fold tabs 64, 66. Bottom sheet 50 is coupled to first and second bottom fold tabs 64, 66 by applying heat and forming a heat seal or any other suitable means. Bottom sheet 50 provides stand-up package 10 with a generally flat bottom that facilitates the ability of stand-up package 10 to maintain an upright standing orientation.

During the filling of stand-up package 10, products are placed into interior product-storage region 14 through an open mouth 78 opening into interior region 14 as suggested in FIG. 1D. Open mouth 78 is formed in stand-up package 10 by distal edges of top sheet 52 and first and second top fold tabs 68, 70. Open mouth 78 is closed during forming of top end seal 76.

During the formation of top end seal 76, second top fold tab 70 is folded inwardly toward interior product-storage region 14. Next, first top fold tab 68 is folded inwardly toward the interior product-storage region to lie in confronting relation with second top fold tab 70. Next, top sheet 52 is folded about top film fold line 63 toward interior region 14 to cause top sheet 52 to overlie first and second top fold tabs 68, 70. Top sheet 52 is coupled to first and second top fold tabs 68, 70 by applying heat and forming a heat seal or any other suitable means.

During the formation of bottom end seal 74, bottom frame panel 26 is folded in a clockwise direction about a bottom frame fold line 80 toward interior product-storage region 14. As a result, bottom panel 26 is arranged to extend away from front panel 24 at about a right angle and lie generally parallel to the floor underlying and supporting stand-up package 10 and generally perpendicular to and between first side panel 30 and second side panel 32. Bottom panel 26 provides stand-up package 10 with a generally flat bottom that facilitates the ability of stand-up package 10 to maintain an upright standing orientation.

Bottom side edge 106 of first side panel 30 of frame 16 is located adjacent and generally parallel to first side edge 92 of bottom panel 26 as suggested in FIG. 4. Bottom side edge 106 of first side panel 30 and first side edge 92 of bottom panel 26 are not directly connected or coupled to one another. First side panel 30 and bottom frame panel 26 are not connected or coupled to one another by any portion of semi-rigid frame 16 other than by front panel 24.

Bottom side edge 112 of second side panel 32 of frame 16 is located adjacent and generally parallel to second side edge 94 of bottom panel 26 as shown in FIG. 4. Bottom side edge 112 of second side panel 32 and second side edge 94 of bottom panel 26 are not directly connected or coupled to one another. Second side panel 32 and bottom panel 26 are not connected or coupled to one another by any portion of semi-rigid frame 16 other than by front panel 24.

During the formation of top end seal 76, top panel 28 is folded in a counter-clockwise direction about a top frame fold line 86 toward interior product-storage region 14. As a result, top panel 28 is arranged to extend away from front panel 24 at about a right angle and lie generally parallel to ground and bottom panel 26 and bottom sheet 50. Each of bottom panel 26, top panel 28, first side panel 30, and second side panel 32 extend in the same direction outwardly from and generally perpendicular to front panel 24.

Top side edge 104 of first side panel 30 of frame 16 is located adjacent and generally parallel to first side edge 98 of top panel 28 as suggested in FIG. 4. Top side edge 104 of first side panel 30 and first side edge 98 of top panel 28 are not directly connected or coupled to one another. First side panel 30 and top panel 28 are not connected or coupled to one another by any portion of semi-rigid frame 16 other than by front panel 24.

Top side edge 110 of second side panel 32 of frame 16 is located adjacent and generally parallel to second side edge 100 of top panel 28. Top side edge 110 of second side panel 32 and second side edge 100 of top panel 28 are not directly connected or coupled to one another. Second side panel 32 and top panel 28 are not connected or coupled to one another by any portion of semi-rigid frame 16 other than by front panel 24.

Bottom and top end seals 74, 76 may be formed in other ways. In one illustrative example, top sheet 52 may not be laminated to top panel 28. As a result, top sheet 52, first top fold tab 68, and second top fold tab 70 may be joined together to form a top end seal without coupling to top panel 28. Such an arrangement may allow for variation in the top end seal. The bottom end seal may also be formed in a similar manner in that bottom sheet 50 may not be laminated to bottom panel 26. Bottom sheet 50, first bottom fold tab 64, and second bottom fold tab 66 may be joined together to form a bottom end seal without coupling to permanently bottom panel 26.

In one example, a semi-rigid frame may formed in accordance with the present disclosure separately from a film pouch without lamination to the film pouch. The semi-rigid frame may then be located in an interior product-storage region formed in the film pouch after the film pouch has been formed. The semi-rigid frame may then be coupled to the film pouch to establish a stand-up package in accordance with the present disclosure. The semi-rigid frame is coupled to the film pouch to block inadvertent removal of the semi-rigid frame from film pouch during use of the stand-up package. In one example, the semi-rigid frame may be coupled using an adhesive to the film pouch, by a heat seal, any other suitable alternative.

As an example, film 18 may be made from polypropylene or other suitable alternative. Semi-rigid frame 16 may also be made from polypropylene so that stand-up package 10 is made from one plastics material providing for maximized simplicity in recycling of stand-up package 10. As a further example, semi-rigid frame 16 may be made from a foamed polypropylene material. Semi-rigid frame 16 may be made from an insulative cellular non-aromatic polymeric material which may comprise, for example, a polypropylene base resin having a high melt strength, one or both of a polypropylene copolymer and homopolymer resin, and one or more cell-forming agents. As an example, cell-forming agents may include a primary nucleation agent, a secondary nucleation agent, and blowing agent defined by gas means for expanding the resins and to reduce density. In one example, the gas means comprises carbon dioxide. Another example, the base resin comprises broadly distributed molecular weight polypropylene characterized by a distribution that is unimodal and not bimodal. Reference is hereby made to U.S. application Ser. No. 13/491,007, filed Jun. 7, 2012 and titled POLYMERIC MATERIAL FOR AN INSULATED CONTAINER for disclosure relating to a polypropylene based insulative cellular non-aromatic polymeric material, which application is hereby incorporated in its entirety herein.

Another embodiment of a stand-up package in accordance with the present disclosure includes a semi-rigid frame 416, shown in FIG. 7, and a film 418 suggested in FIG. 8. During a package-forming operation in accordance with the present disclosure, a film blank 402, as shown in FIG. 9, is laminated to a frame blank 404, as shown in FIG. 8, to establish a laminated package blank 412 as shown in FIG. 10. Laminated package blank 412 is formed to establish an opened package having an interior product-storage region 414 suitable for receiving products, such as food, therein. The opened package is then closed using a heat seal or adhesive to establish a closed package suitable for storage or transportation.

Semi-rigid frame 416 includes a front panel 424, a first side panel 430, a second side panel 432, and a rear panel 406 as shown in FIG. 7. Each of the frame panels 424, 430, 432, and 406 are formed to include a rectangular aperture 424A, 430A, 432A, and 406A that is arranged to open into interior region 414. Apertures 424A, 430A, 432A, and 406A minimize weight of semi-rigid frame 416.

Semi-rigid frame 416 is formed from frame blank 404 as shown, for example, in FIG. 8. Frame blank 404 includes a first frame strip 401, a front frame strip 403, a second frame strip 405, a rear frame strip 407, and a coupling strip 409 as shown in FIG. 8. First frame strip 401 is coupled to front frame strip 403 along a first frame fold line 482 to fold in a rearward direction 11 as suggested in FIG. 7. Second frame strip 405 is coupled to front frame strip 403 along a second frame fold line 484 in rearward direction 11. Second frame strip 405 is coupled to rear frame strip 407 along a third frame fold line 485 to fold in a direction toward first frame strip 401. Coupling strip 409 is coupled to rear frame strip 407 along a coupling fold line 408 to fold in a direction opposite rearward direction 11 toward first frame strip 401.

First frame strip 401 includes a first top wing 401A, first frame panel 430, and first bottom wing 401B. Front frame strip 403 includes top front tab 403A, front frame panel 424, and bottom front tab 403B. Second frame strip 405 includes a second top wing 405A, second frame panel 432, and a second bottom wing 405B. Rear frame strip 407 includes a top rear tab 407A, rear frame panel 406, a bottom rear tab 407B as shown in FIG. 8.

Film 418 is formed from film blank 402 as shown, for example, in FIG. 9. Film blank 402 includes a first film band 411, a front film band 413, a second film band 415, a rear film band 417, and a coupling band 419 as shown in FIG. 9. First film band 411 is coupled to front film band 413 along a first film fold line 483 to fold in rearward direction 11 as suggested in FIG. 7. Second film band 415 is coupled to front film band 413 along a second film fold line 487 in rearward direction 11. Second film band 415 is coupled to rear film band 417 along a third film fold line 489 to fold in a direction toward first film band 411. Coupling band 419 is coupled to rear film band 417 along a coupling-band fold line 490 to fold in a direction opposite rearward direction 11 toward first film band 411.

First film band 411 includes a first top flap 411A, first side sheet 431, and first bottom flap 411B as shown in FIG. 9. Front film band 413 includes top front flap 413A, front sheet 433, and bottom front flap 413B. Second film band 415 includes a second top flap 415A, second side sheet 435, and a second bottom flap 415B. Rear film band 417 includes a top rear flap 417A, rear sheet 437, and a bottom rear flap 417B as shown in FIG. 8.

Film blank 402 is laminated to frame blank 404 to produce laminated blank 412 as shown, for example, in FIG. 10. As a result, first film band 411 is arranged overlie first frame strip 401 and cover aperture 430A. Front film band 413 is arranged to overlie front frame strip 403 and cover aperture 424A. Second film band 415 is arranged to overlie second frame strip 405 and cover aperture 432A. Rear film band 417 is arranged to overlie rear frame strip 407 and cover aperture 406A. Coupling band 419 is arranged to overlie coupling strip 409.

The invention claimed is:

1. A package comprising a film-rigidifying frame including a front panel having a perimeter edge, a first side panel coupled to a first side segment of the perimeter edge of the front panel and arranged to lie at about a right angle to the front panel, a second side panel coupled to a second side segment of the perimeter edge of the front panel and arranged to lie at about a right angle to the front panel and in substantially spaced-apart parallel relation to the first side panel and a pouch made of a thin plastics film sheet material and formed to include an interior region adapted to contain products therein and sized to receive the film-rigidifying frame therein, wherein the pouch includes a front sheet having an interior surface arranged to face toward the interior region and coupled permanently to an exterior surface of the front panel to rigidify the front sheet, a first side sheet having an interior surface arranged to face toward the interior region and coupled permanently to an exterior surface of the first side panel to rigidify the first side sheet, and a second side sheet having an interior surface arranged to face toward the interior region and the first side sheet and coupled permanently to an exterior surface of the second side panel to rigidify the second side sheet, and a closure coupled to each of the front sheet, first side sheet, and the second side sheet to establish the interior region of the pouch as a closed volume.

2. The package of claim 1, wherein the closure of the pouch includes a bottom sheet coupled to a bottom edge of each of the front sheet and first and second side sheets, a top sheet coupled to an opposite top edge of each of the front sheet and the first and second side sheets and arranged to lie in substantially spaced-apart parallel relation to the bottom sheet, and a rear sheet coupled to each of the first, second, top, and bottom sheets and arranged to lie in substantially spaced-apart parallel relation to the front sheet.

3. The package of claim 2, wherein the rear sheet is formed to define a portion of the interior region of the pouch.

4. The package of claim 3, wherein the film-rigidifying frame is separated from the rear sheet of the pouch.

5. The package of claim 3, wherein the perimeter edge of the front panel further includes a bottom segment arranged to interconnect the first and second side segments, the film-rigidifying frame further includes a bottom panel coupled to the bottom segment of the perimeter edge of the front panel and arranged to lie at about a right angle to the front panel, and the bottom sheet of the pouch has an interior surface arranged to face toward the interior region and coupled permanently to an exterior surface of the bottom panel to rigidify the bottom sheet.

6. The package of claim 5, wherein the perimeter edge of the front panel further includes a top segment arranged to interconnect the first and second side segments and lie in substantially spaced-apart parallel relation to the bottom segment, the film-rigidifying frame further includes a top panel coupled to the top segment of the perimeter edge of the perimeter edge of the front panel and arranged to lie at about a right angle to the front panel, and the top sheet of the pouch has an interior surface arranged to face toward the interior region and coupled permanently to an exterior surface of the top panel to rigidify the top sheet.

7. The package of claim 6, wherein the film-rigidifying frame is separated from the rear sheet of the pouch.

8. The package of claim 6, wherein the first side edge, bottom edge, second side edge, and top edge are arranged to lie in series to provide the perimeter edge of the front panel with a rectangular shape.

9. The package of claim 8, wherein the front panel further includes an interior edge arranged to lie in spaced-apart relation to the perimeter edge and to have a rectangular shape to cause the front panel to mate only with a perimeter border portion of the front sheet.

10. The package of claim 2, wherein the film-rigidifying frame further includes a rear panel coupled to each of the first and second side panels and arranged to extend from the first side panel to the second side panel and lie in substantially spaced-apart parallel relation to the front panel, and the rear sheet of the pouch has an interior surface arranged to face toward the front sheet of the pouch and coupled permanently to an exterior surface of the rear panel to rigidify the rear sheet.

11. The package of claim 10, wherein the perimeter edge of the front panel further includes a bottom segment arranged to interconnect the first and second side segments, the film-rigidifying frame further includes a bottom panel coupled to the bottom segment of the perimeter edge of the front panel and arranged to lie at about a right angle to the front panel, and the bottom sheet of the pouch has an interior surface arranged to face toward the interior region and coupled permanently to an exterior surface of the bottom panel to rigidify the bottom sheet.

12. The package of claim 11, wherein the perimeter edge of the front panel further includes a top segment arranged to interconnect the first and second side segments and lie in substantially spaced-apart parallel relation to the bottom segment, the film-rigidifying frame further includes a top panel coupled to the top segment of the perimeter edge of the front panel and arranged to lie at about a right angle to the front panel, and the top sheet of the pouch has an interior surface arranged to face toward the interior region and coupled permanently to an exterior surface of the top panel to rigidify the top sheet.

13. The package of claim 12, wherein each of the front, rear, first side, and second side panels are formed to include an interior edge forming a boundary of an aperture.

14. The package of claim 12, wherein each of the front, rear, first side, and second side panels are rectangle-shaped and formed to include a rectangle-shaped aperture therein.

15. The package of claim 1, wherein the front panel further includes an interior edge arranged to lie in spaced-apart relation to the perimeter edge and to have a rectangular shape to cause the front panel to mate only with a perimeter border portion of the front sheet.

16. A package comprising a film pouch made of a plastics film material and arranged to define an interior region adapted to contain products therein and a film-rigidifying frame located in the interior region and coupled to the film pouch, the film-rigidifying frame being configured to provide means for mating with an interior surface of the film pouch to rigidify the film pouch to maintain the interior region in an opened state to receive products therein and to cause the film pouch to extend in an upward direction away from ground underlying the film pouch so that the film pouch assumes an upright position and has a generally rectangular shape when viewed from a front of the package, wherein the film-rigidifying frame includes a front panel, a first side panel coupled to the front panel and arranged to extend in a rearward direction, and a second side panel coupled to the front panel and arranged to lie in substantially spaced-apart parallel relation to the first side panel.

17. The package of claim 16, wherein the film pouch includes a front sheet arranged to overlie and couple to the front panel, a first side sheet coupled to the front sheet and arranged to overlie and couple to the first side panel, and a second side sheet arranged to overlie and couple to the second panel.

18. The package of claim 17, wherein the film pouch further includes a rear sheet arranged to lie in substantially spaced-apart parallel relation to the front sheet and extend between and interconnect the first and second side sheets.

19. The package of claim 16, wherein the film-rigidifying frame further includes a rear panel arranged to lie in spaced-apart parallel relation to the front panel and to extend between and interconnect the first and second side panels to cause support provided to the film pouch to be maximized.

20. The package of claim 19, wherein the film pouch includes a front sheet arranged to overlie and couple to the front panel and a rear sheet arranged to lie in substantially spaced-apart parallel relation to the front sheet and overlie and couple to the rear panel.

* * * * *